US012103645B2

(12) United States Patent
Vishnevsky et al.

(10) Patent No.: US 12,103,645 B2
(45) **Date of Patent: *Oct. 1, 2024**

(54) PORTABLE MARINE ANCHORING DEVICE

(71) Applicant: WavesRx LLC, Sarasota, FL (US)

(72) Inventors: Andrew Vishnevsky, Sarasota, FL (US); Radu Oboroc, Bradenton, FL (US)

(73) Assignee: WavesRX, LLC, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/330,161

(22) Filed: Jun. 6, 2023

(65) Prior Publication Data

US 2023/0322333 A1 Oct. 12, 2023

Related U.S. Application Data

(63) Continuation of application No. 17/110,663, filed on Dec. 3, 2020, now Pat. No. 11,713,099.

(51) Int. Cl.
*B63B 21/30* (2006.01)
*B63B 21/20* (2006.01)

(52) U.S. Cl.
CPC ..... *B63B 21/30* (2013.01); *B63B 21/20* (2013.01); *B63B 2231/06* (2013.01); *B63B 2231/10* (2013.01); *B63B 2231/18* (2013.01); *B63B 2231/34* (2013.01); *B63B 2231/42* (2013.01); *B63B 2231/52* (2013.01)

(58) Field of Classification Search
CPC ... B63B 21/00; B63B 2021/003; B63B 21/20; B63B 21/30; B63B 21/24; B63B 21/26; B63B 21/50; B63B 2231/00; B63B 2231/06; B63B 2231/10; B63B 2231/18; B63B 2231/34; B63B 2231/42; B63B 2231/52
USPC ..... 114/230.1, 230.2, 230.26, 293, 294, 295
See application file for complete search history.

(56) References Cited

U.S. PATENT DOCUMENTS

| | | | | | |
|---|---|---|---|---|---|
| 3,495,565 | A * | 2/1970 | Verner | E02B 3/24 | 114/230.1 |
| 5,806,453 | A * | 9/1998 | Cook | B63B 21/24 | 114/230.1 |
| 6,481,364 | B2 * | 11/2002 | Woyjeck | A01K 1/04 | 114/294 |
| 7,302,904 | B2 * | 12/2007 | Burns | E04H 15/62 | 114/294 |
| 10,035,567 | B1 * | 7/2018 | Baker | B63B 21/26 | |

* cited by examiner

*Primary Examiner* — Daniel V Venne
(74) *Attorney, Agent, or Firm* — Thomas H. Stanton

(57) ABSTRACT

A portable marine anchoring device maximizes holding capacity while anchored into the ground. The device is fabricated from lightweight aluminum.

4 Claims, 11 Drawing Sheets

Front
Proximal end

Front Distal
end

PORTABLE MARINE ANCHORING DEVICE

CROSS-REFERENCE TO RELATED APPLICATIONS

This application and is a Continuation of and claims priority to application Ser. No. 17/110,663, now U.S. Ser. No. 11/713,099 B2 which is incorporated by reference in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

TRADEMARK STATEMENT

Trademarks used in the disclosure of the invention and the applicants make no claim to any trademarks referenced.

BACKGROUND OF THE INVENTION

1) Field of the Invention

The present invention relates generally to a portable marine anchoring device. More so, the anchoring device is a portable, lightweight anchor; and configured to anchor into the ground with enhanced holding capacity, while tethered to a marine vehicle; whereby the anchoring device provides an anchoring stake having unique structural configurations that serve to increase the resistive forces against the ground, and further having a sloped disposition in relation to the ground that serves to increase the required vector force necessary to dislodge the anchoring stake.

2) Description of Related Art

The prior art has numerous inventions which describe the method of anchoring a boat. Most of the prior art describes the traditional way of anchoring a boat which is to drop a single anchor from the bow and drift or power the boat backwards. In this position the boat can swing side-to-side depending on wind and wave conditions. In some cases, the anchor can be dropped from the stern and the boat powered forward. This latter stern anchoring is generally not done on large vessels because it can be unsafe under some weather and traffic conditions. However, it is very commonly used for small boats in the 16' to 22' range for temporary anchoring. In either case, the boat swings side-to-side is similar but not the same amount.

When a boat is anchored so that the occupants can enjoy the beach the current practice is to use a traditional anchor and place it on the beach and have a second anchor attached to the bow so that the boat is anchored from two positions on the boat. However, traditional anchors are not designed to hold in sand normally found on a beach and often pull out or allow the boat to move. Also, traditional anchors are heavy and create a tripping hazard for individuals on the beach.

Therefore, there is a need for an anchor that is light weight, does not create a tripping hazard and is designed to hold in sand.

BRIEF DESCRIPTION OF THE DRAWINGS

The invention will now be described, by way of example, with reference to the accompanying drawings, in which.

Like reference numerals refer to like parts throughout the various views of the drawings.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
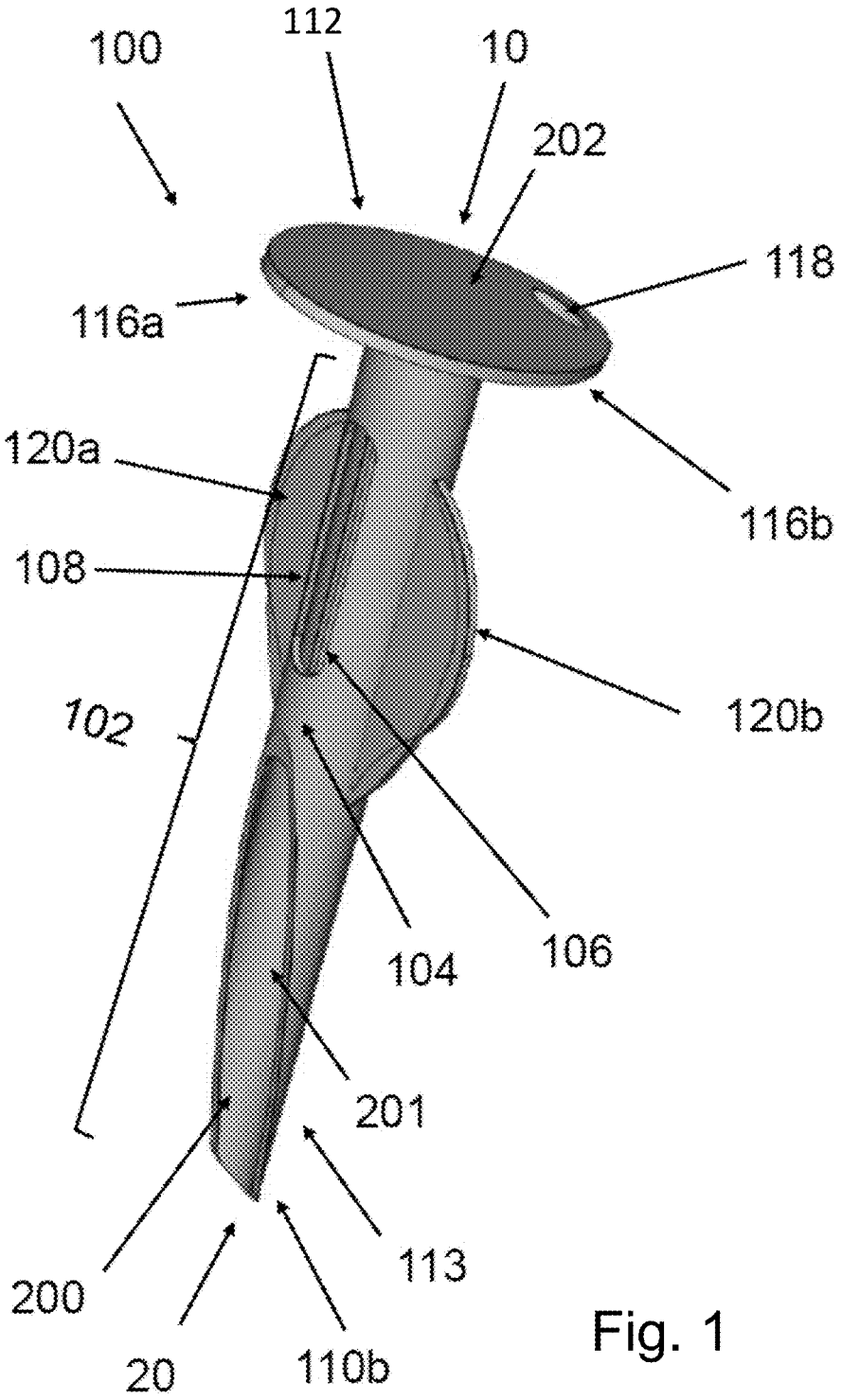
FIG. 1 illustrates a perspective as viewed from the step plate or proximal end and front of the portable marine anchoring device, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure be considered as an example of the principles of the invention and not intended to limit the invention to the specific embodiments shown and described.

The terms people, boater, consumer and individual are used interchangeably to mean an individual who uses the invention.

The term boat and marine vehicle as used within the specification of the invention is intended to mean any vessel and including and not limited to a power boat, wave runner, jet ski or sailboat that is tied to the instant invention by a rope, line, chain or other tethering device.

The term sand as used within the specification of the invention is intended to mean sand or loose uncompacted soil.

The prior art does not provide for an anchor that is light weight, does not create a tripping hazard and is designed to hold in sand or loose uncompacted soil. The prior art includes the following marine anchor related patents: U.S. Pat. Nos. 3,651,777; 4,027,615; 5,154,133; 4,945,850; and US20160194058, which are incorporated by reference herein in their entirety.

The instant invention is a lightweight and compact which makes it easy to carry and the reduced size makes it less bulky than traditional anchors which facilitates storage on a small boat.

The instant invention is primarily an anchor having a linear shape with a proximal end having the step plate with the attachment for the rope or line connecting the anchor to the boat and a hollow light weight tube attached to the step plate forming a stake having a point at the distal end of the anchor. The hollow tube is attached to the step plate such that an acute angle is formed between the step plate and the hollow tube. In one embodiment the hollow tube has either single or multiple plates attached to the hollow tube thereby forming at least a left plate and a right plate and each plate having a surface parallel to the hollow tube. The hollow tube is also modified by cutting the tube on an angle in the axial direction and parallel with the left plate and a right plate surface from approximately under the left and right plates such that the diameter of the tube at the distal end is semicircular in shape and the tube is a complete circular shape proximal to the left and right plates. The cut increases the surface area which creates more resistance against the sand or uncompacted soil that it is inserted into without having to increase the overall size of the anchor. The size of the right and left plates is selected to increase the projected area and creates a focal point for counteracting the overturning moment created by the force applied to the anchor by the boat or floating marine vehicle. The resistance created by the right and left plates increases the anchor's holding capacity. The top step-on plate is attached to the hollow tube at an acute angle so that when the anchor is inserted in the sand or uncompacted soil it is at an acute angle from the vertical axis with distal end oriented towards the boat. This increases the holding power of the anchor as the force applied by the boat is directed at an acute angle from the horizontal axis. Because the anchor is being pulled slightly down when under tension, it drastically reduces the likelihood of it being pulled out of the sand or uncompacted soil.

The embodiments described in the present invention are presented in FIGS. 1-11 and are not intended to be exclusive to any particular design but to provide examples of typical construction. The portable marine anchoring device 100 is configured to anchor into the sand or uncompacted soil in a manner that maximizes holding capacity, while tethered to a boat or floating marine vehicle. The portable marine anchoring device 100, hereafter "device 100", is a portable, lightweight marine anchor that has the advantages of being manufactured from a lightweight material such as aluminum, aluminum alloys, titanium, stainless steel, iron, beryllium, magnesium alloys, metal alloys, polymers, wood and carbon reinforced plastics. The use of lightweight construction for the device 100 facilitates transport while being carried to a desired anchor point either on a beach or in shallow water. The device 100 has enhanced holding capacity when embedded into the sand or uncompacted soil through creation of a resisting moment arm that counteracts the overturning moment applied to the device 100 by the tether attached to the boat or floating marine vehicle.

Referring to FIG. 1 the device 100 is an anchor having a linear shape with a proximal end 10 having the step plate 112 with the attachment eye 118 for the rope connecting the anchor to the boat and a hollow tube 113 forming elongated anchoring stake 102 attached to the step plate 112 forming a stake having a point at the distal end 20 of the device 100. The hollow tube 113 is attached to the step plate 112 such that an acute angle is formed between the step plate 112 and the hollow tube 113. In the preferred embodiment the step plate 112 is welded to the proximal terminus 150 of the hollow tube 113 however any attachment method can be used such as welding, screw, or pin connection.

The hollow tube 113 having two plates attached to the hollow tube 113 forming a left plate 120*a* and a right plate 120*b*. The hollow tube 113 is also modified by cutting the tube on an angle in the axial direction from approximately under the left and right plates 120*a* and 120*b* such that the diameter of the tube at the distal end is reduced to a semicircular shape and the tube is a complete circular shape proximal to the left and right plates 120*a* and 120*b*. This creates a cupped feature 201 in the elongated hollow tube 113 anchoring stake 102 that increases the surface area which creates more resistance against the sand or uncompacted soil 308 that device 100 is inserted into without having to increase the overall size of the device 100. The size of the right and left plates 120*a* and 120*b* is selected to increase the projected area of the right and left plates 120*a* and 120*b* and create a focal point for counteracting the overturning moment created by the force applied to the device 100 by the boat or floating marine vehicle attached to a rope connecting the anchor to the boat or floating marine vehicle. The resistance created by the right and left plates increases the anchor's hold capacity by increasing the surface area resisting the movement of the anchoring stake 102 against the overturning moment created by the force applied to the device 100 by the boat or floating marine vehicle 304 shown in FIG. 3.

The hollow tube 113 of anchoring stake 102 is preferably cylindrical in shape. However, round, rectangular, triangular, cruciform, or other irregular shape, so as to affect the overall shape and dimensions of the anchoring stake 102 can be used. It could also be made from shape material similar to a metal fence post or a cruciform shape and additional holes can be added to reduce the weight of the device 100 as long as the additional holes do not decrease the structural integrity of the device 100.

Anchoring stake 102 comprises of a sidewall 104, the sidewall 104 defining an elongated cavity 106, the sidewall 104 can have an outlet opening 108 in fluid communication with the cavity 106 to facilitate removal of sand or uncompacted soil 308 from elongated cavity 106.

The anchoring stake 102 further comprising a front surface 110*b* of the anchoring stake 102 and a back surface 110*b* at the distal end of the anchoring stake 102, the back surface 110*b* forming an inlet opening 200 which is parabolic in shape and in fluid communication with the cavity 106.

The step plate 112 defined by a generally flat plate which can be any reasonable shape including but not limited to round, square, rectangular or oval in shape. The step plate 112 comprising a top surface 202 with an opposing bottom surface 114, the step plate 112 further comprising a free end 116*a* and a tether end 116*b*, the tether end 116*b* having a tether attachment eye 118. The attachment eye 118 can be a hole in step plate 112 or an attachment mechanism capable of attaching a tether from the boat or marine vessel 304.

Figure 3:
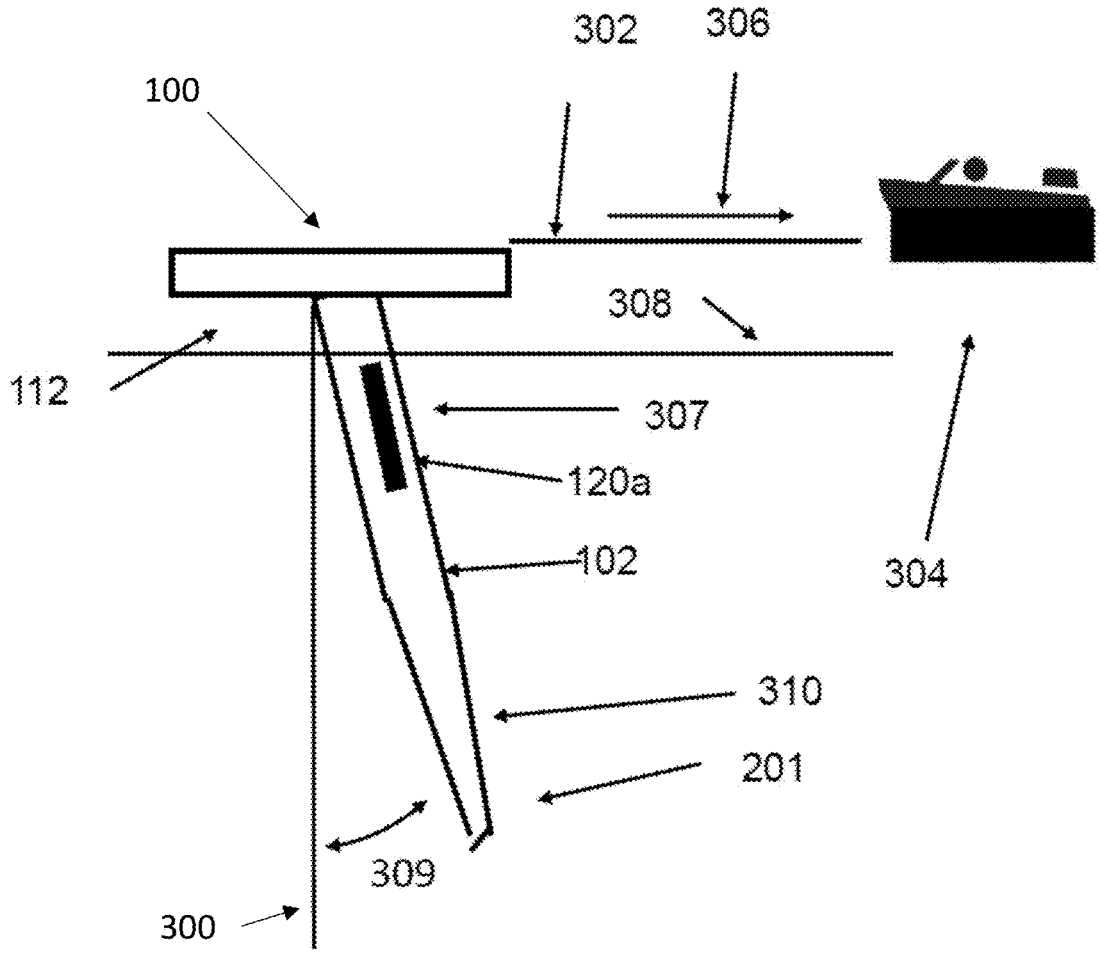
FIG. 3 illustrates a view of an exemplary anchoring stake embedded into the ground at an acute angle that slopes forward, in accordance with an embodiment of the present invention.

Continuing the description of FIG. 1, the device 100 comprises an elongated anchoring stake 102, defined by unique structural components that increase resistive forces against the sand or uncompacted soil 308 as shown in FIG. 3, when embedded in the sand or uncompacted soil 308. The left and right plates 120*a* and 120*b* that project outwardly along the length of the anchoring stake 102 can be formed from either one or two plates attached to the hollow tube 113. The wings 120*a*, 120*b* serve to increase resistance forces against the sand or uncompacted soil 308 when embedded in the sand or uncompacted soil 308. The wings 120*a*, 120*b* provide a focal point for the counteracting force applied to the anchor by the boat or floating marine vehicle as shown in FIG. 3.

The elongated cavity 106 that is formed from the proximal end 10 to distal end 20 of the anchoring stake 102 in hollow tube 113 allows sand or uncompacted soil 308 to enter the cavity 106 when the device 100 is inserted into the sand or uncompacted soil 308. The cavity 106 is in fluid communication with an inlet opening 200 that receives the sand or loose uncompacted soil 308 when the anchoring stake 102 penetrates the sand or uncompacted soil 308. Cavity 200 provides device 100 with two benefits. The first benefit is that the hollow tube 113 allows the sand or uncompacted soil to flow into the device 100 which reduces the force required to insert the device 100 into the sand or uncompacted soil 308. The second benefit is that the cupped feature 201 formed in the hollow tube 113 in the elongated anchoring stake 102 increases the surface area which creates more resistance against the sand or uncompacted soil 308 that device 100 is inserted into without having to increase the overall size of the device 100. The cupped feature 201 resist the overturning moment created by the force applied to the device 100 by the boat or floating marine vehicle 304.

Figure 2:
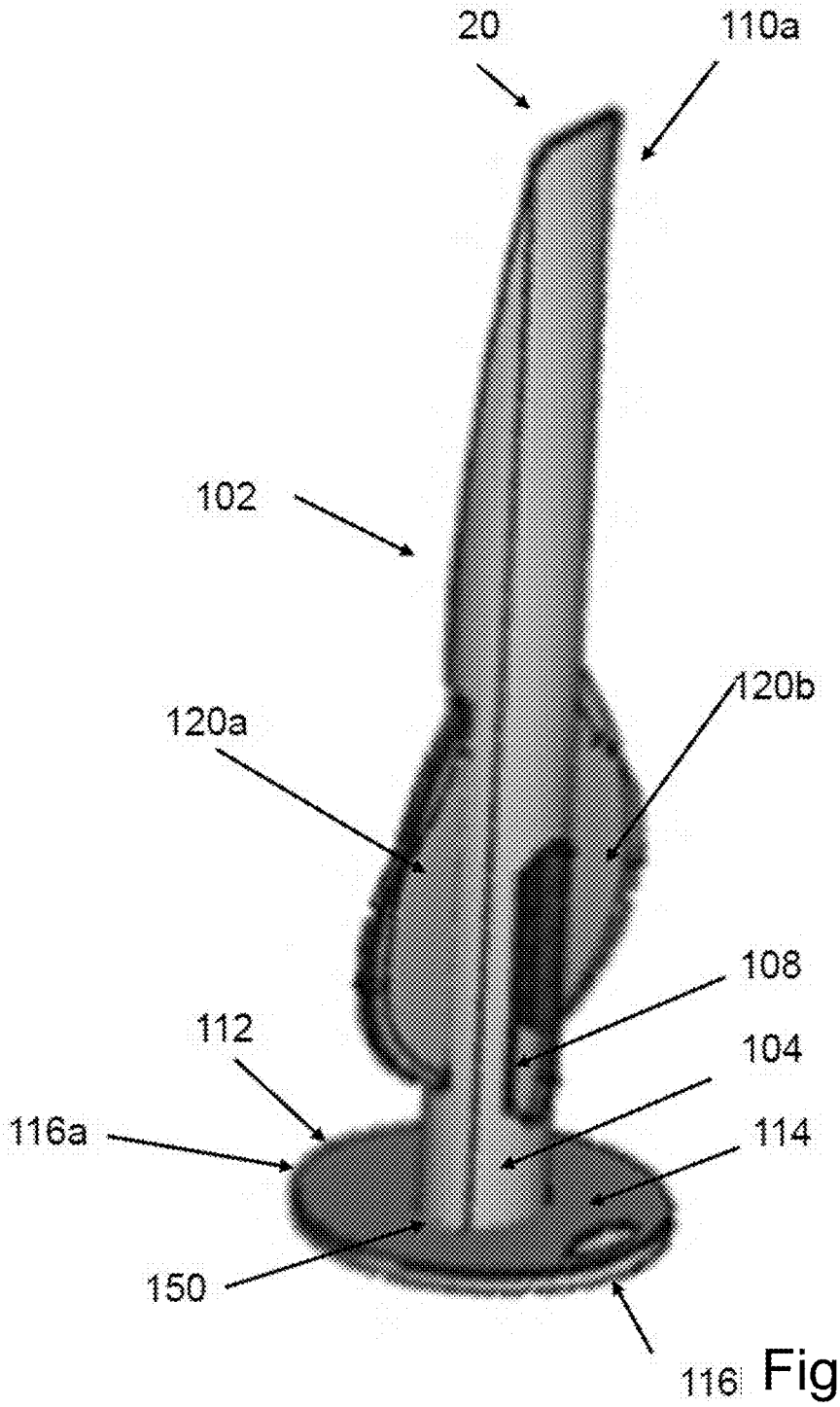
FIG. 2 illustrates a perspective view from the distal end and back side of the portable marine anchoring device, in accordance with an embodiment of the present invention.

FIG. 2 illustrates another unique structural configuration for the anchoring stake 102. An at least one outlet opening 108 forms in the sidewalls 104 of the anchoring stake 102 running from front to back of the device 100. The at least one outlet opening 108 enables excess sand or loose uncompacted soil 308 from the interior cavity 106 to escape, to facilitated cleaning of the anchoring stake 102 after use.

Furthermore, expanding on FIG. 1 and FIG. 2, the anchoring stake 102 has a sidewall 104, which is fabricated from the aforementioned light weight material. The sidewall 104 is elongated and can be generally cylindrical in shape, defining an elongated cavity 106 therein. As noted previously the cavity 106 is sized and dimensioned to receive and retain the sand or loose uncompacted soil 308 as the anchoring stake 102 is driven into the sand or uncompacted soil 308. The sidewall 104 also has at least one outlet opening 108 that is in fluid communication with the cavity 106. In some embodiments, the at least one outlet opening 108 comprises of either multiple elliptical, round, rectangular or oval holes on each side of the anchoring stake 102 or they can be two identical, elongated openings that form along the longitudinal direction of the anchoring stake 102. The at least one outlet opening 108 is sized and dimensioned to provide an outlet for excess sand or loose uncompacted soil that accumulates in the cavity 106 of the anchoring stake 102.

Referring to FIG. 3 another unique structural configuration is that the anchoring stake 102 is disposed at an acute slope, in relation to a vertical axis 300. Consequently, while embedded in the sand or uncompacted soil 308, the anchoring stake 102 is not at a vertical, but rather slopes forward in the direction of the tethered boat or marine vehicle 304. The acute angle can be from 1 to 50 degrees but preferably 15 degrees in an approximate orientation away from a tether line attached to the boat or marine vehicle 304. This sloped disposition of the anchoring stake 102 serves to increase the required vector force 306 necessary to dislodge the anchoring stake 102 from the sand or uncompacted soil 308.

In operation, the marine vehicle and/or the motion of the body of water results in force 306 to pull step plate 112 at attachment eye 118. Force 306 results in a reaction force 307 at the right and left plates 120*a* and 120*b* and a counter reaction force 310 at cupped feature 201.

To pull the device 100 anchoring stake 102 out of the sand or uncompacted soil the force 306 must overcome the forces 307 and 310 and since the anchoring stake 102 is disposed at an acute angle 309 to the vertical axis 300 and sloped upward and away from the marine vehicle; the force 306 must also pull the anchoring stake 102 to beyond a vertical axis 300, before the anchoring stake 102 can dislodge from the sand or uncompacted soil 308. The combination of balanced forces and the angled insertion of the anchoring stake 102 increases the required force 306 necessary to dislodge the anchoring stake 102 of device 100 from the sand or uncompacted soil 308.

Figure 4:
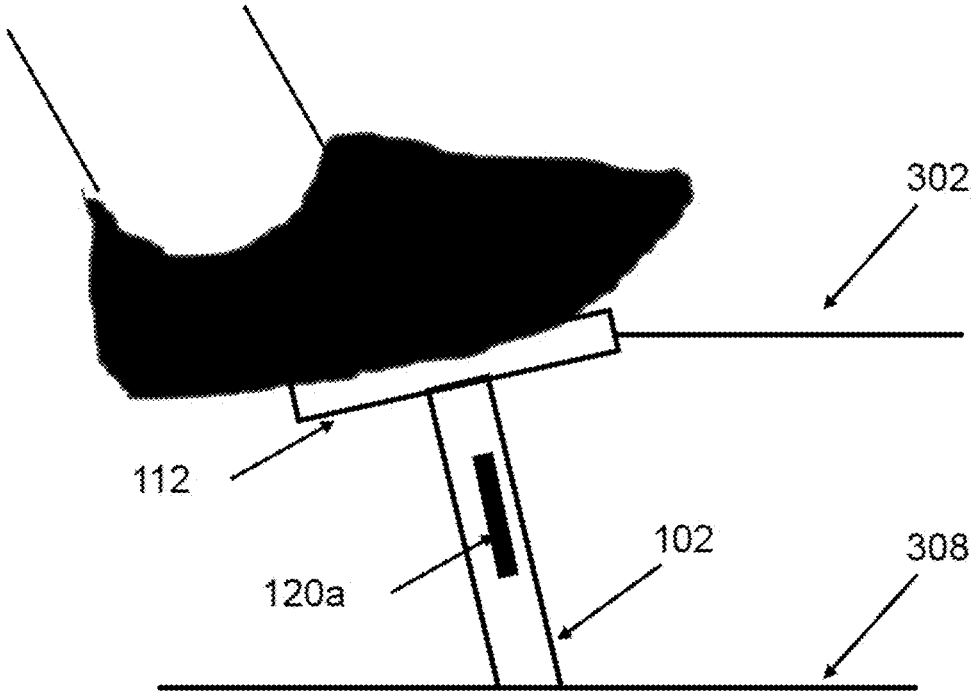
FIG. 4 illustrates a view of an exemplary step plate being pressed into the ground to embed the anchoring stake therein, in accordance with an embodiment of the present invention.
Figure 5:
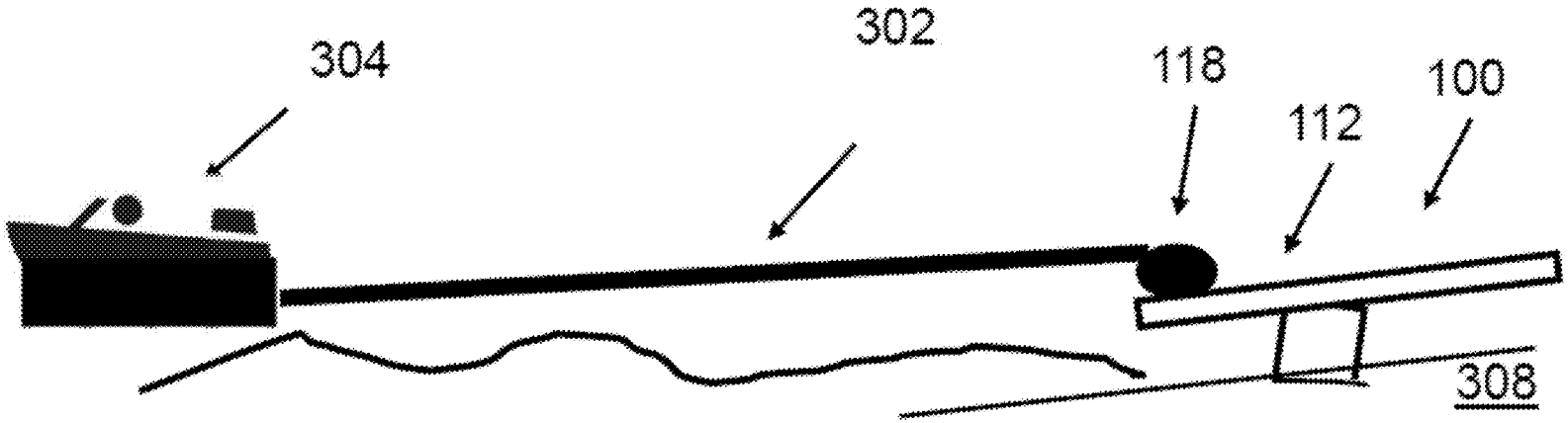
FIG. 5 illustrates a view of an exemplary marine vehicle tethered to the portable marine anchoring device, in accordance with an embodiment of the present invention.

As illustrated in FIGS. 4 and 5, the device 100 comprises an anchoring stake 102 and step plate 112, which is embedded into the sand and uncompacted gravel 308 for anchoring a marine vehicle 304. In some embodiments, the sand and uncompacted soil 308 may include, without limitation, sand, gravel, a seabed, a riverbed, an ocean floor. The anchoring stake 102 is configured to entirely embed into the sand and uncompacted soil 308, while being attached to the marine vehicle 304 through the tether 302. The marine vehicle that tethers to the anchoring stake 102 may include, without limitation, a jet ski, wave runner, rowboat, canoe, motorboat, a raft, a small boat, and a sailboat.

In some embodiments, the anchoring stake 102 is fabricated, at least partially, from a lightweight material. One preferred material is aircraft grade aluminum. The use of aluminum for device 100 creates a lightweight anchor that is easy to carry on and off the marine vehicle 304; allowing a user to swim while carrying the device 100 to a desired anchor point. In one possible embodiment, the device 100 has a weight of 1 to 10 pounds. However, the weight is preferably one pound. This lightweight configuration is advantageous when compared to the existing prior art beach anchors that are bulky, long, and heavy, and are difficult to carry on and off the marine vehicle. However, since the device 100 is scalable, the weight may be greater or smaller than the preferred weight.

Figure 6:
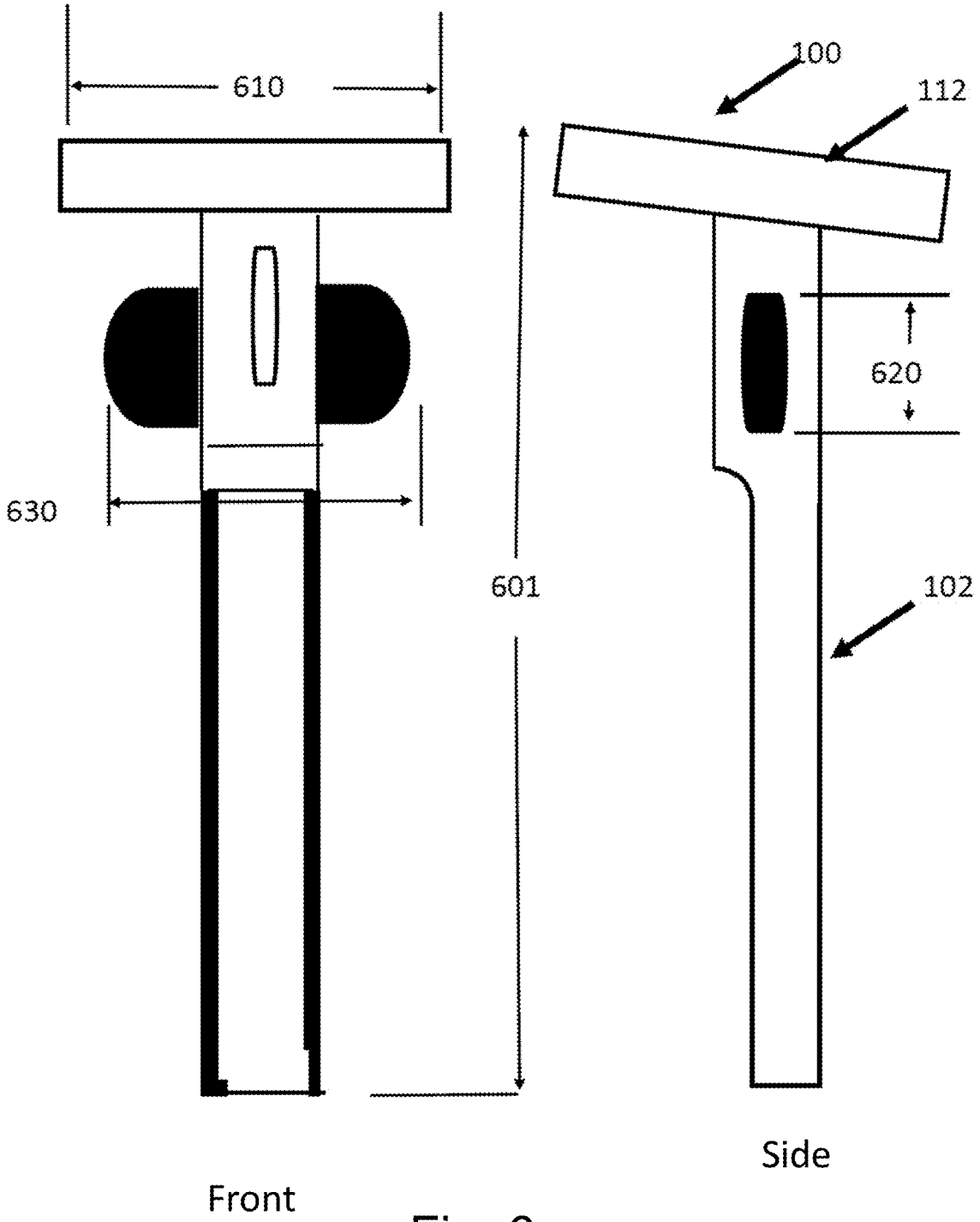
FIG. 6 illustrates a frontal and side view looking from the distal end of the portable marine anchoring device, showing exemplary dimensions, in accordance with an embodiment of the present invention.

Referring to FIG. 6 there is shown a typical lightweight device and typical dimensions. The anchoring stake 102 has a length 601 from 6 inches to 30 inches but preferably 16.5 inches. Step plate diameter 610 can be any value from 2 to 10 inches. Wings 120*a* and 120*b* dimension 620 can be any value from inches 2 to 7 inches and dimension 630 can be any value from 3 to 10 inches. The anchoring stake 102 diameter proximal to the step plate 112 is greater than the diameter of the distal end 20 of the anchoring stake 102. This creates a tapering effect. In any case, the device 100 is scalable; and thus, any dimensions greater or less than the aforementioned may be used.

The device 100 has a proximal end 10 having the step plate 112 that is oriented away from the sand or uncompacted soil 308 when inserting into the sand or uncompacted soil 308 and an opposing distal end 20 that is oriented towards the sand or uncompacted soil 308 when inserting into the sand or uncompacted soil 308 during anchoring operations. When fully embedded into the sand or uncompacted soil 308 the distal end 20 penetrates the surface of the sand or uncompacted soil 308 such that the right and left plates 120*a* and 120*b* are below the surface of the sand or uncompacted soil 308. In some embodiments, the inlet opening 200 extends below right and left plates 120*a* and 120*b* of the anchoring stake 102.

As shown in FIGS. 1, 2, 4 and 5, when inserting device 100 into the sand or uncompacted soil 308 during anchoring operations, sand or loose uncompacted soil 308 enters the inlet opening 200 to fill the cavity 106. The sand or loose uncompacted soil 308 may include sand, gravel, clay, and granules of soil.

Additional structural configurations of the device 100 include a lightweight material such as aluminum, aluminum alloys, titanium, stainless steel, iron, beryllium, magnesium alloys, metal alloys, polymers, wood and carbon reinforced plastics to facilitate transport while being carried to a desired anchor point in a body of water. The preferred materials such as aluminum, aluminum alloys, carbon reinforced plastics or titanium provide the added advantage that they do not rust. Rust can adhere to the marine vehicle 304 while the device 100 is mounted and stored in marine vessel 304 which can result in staining of the marine vessel 304 surfaces.

In one aspect, a portable marine anchoring device 100, comprises:

an anchoring stake 102 comprising a sidewall 104, the sidewall 104 defining an elongated cavity 106, the sidewall 104 forming at least one outlet opening 108 in fluid communication with the cavity 106, the anchoring stake 102 further comprising a front surface 110*a* and a back surface 110*b*, the back surface 110*b* forming an inlet opening 200 in fluid communication with the cavity 106, the anchoring stake 102 being at least partially fabricated from a lightweight material;

a step plate 112 defined by a generally flat plate which can be either round, square, rectangular or oval in shape, the step plate 112 comprising a top face 202 and an opposing bottom face 114, the step plate 112 further comprising a free end 116*a* and a tether end 116*b*, the tether end 116*b* forming a tether attachment eye 118, the bottom face 114 of the step plate 112 being joined with the proximal end of anchoring stake 102, such that the anchoring stake 102 slopes downward towards the tether end 116*b* of the step plate 112;

multiple wings 120*a*, 120*b* projecting from the sidewall 104 of the anchoring stake 102 can be formed from a single plate or multiple plates and the shape can be round, square, rectangular or parabolic in shape; and a tether 302 connecting the tether attachment eye 118 in the step plate 112, to a marine vehicle 304 floating on a body of water.

In another aspect, the size of the front surface 110*a* of the anchoring stake 102 is greater than the diameter of the back surface 110*b* of the anchoring stake 102.

In another aspect, the at least one outlet opening 108 comprises two identical, elongated openings.

In another aspect, the instant invention can have two sets of wings 120*a*, 120*b* one located at the proximal end of hollow tube 113 and another set at the distal end of hollow tube 113.

In another aspect, the sand or uncompacted soil 308 includes at least one of the following: sand, a gravel surface, a seabed, a riverbed and ocean floor.

In another aspect, the device 100 further includes two anchor mounts that serve to detachably mount the device 100 in a storage compartment of the marine vehicle 304.

One objective of the present invention is to help boaters, fishermen and jet ski operators anchor their watercraft near the beach, shore, or in shallow water.

Another objective is to provide a lightweight aluminum anchor that is easy to carry on and off the marine vehicle, and also to swim with to the desired anchor point.

Yet another objective is to provide an anchoring device 100 that is sufficiently compact for all kinds of watercraft, from small jet skis to large boats that are 27 feet or longer.

An exemplary objective is to provide a step plate 112 that lays flush against the sand or uncompacted soil 308, so even if stepped on accidentally, it minimizes the danger of cut and injury due to the low profile.

An exemplary objective is to provide an anchor that is fabricated entirely from light weigh material such as aircraft grade aluminum, which is corrosion resistant and does not rust.

Additional objectives are to provide a portable marine anchoring device 100 that is inexpensive to manufacture.

In some embodiments, the anchoring stake 102 is fabricated, at least partially, from aircraft grade aluminum. The aluminum configuration of the anchoring stake 102 creates a lightweight anchor that is easy to carry on and off the marine vehicle; allowing a user to swim while carrying the device 100 to a desired anchor point. This lightweight configuration is advantageous to prior art beach anchors that are bulky, long, and heavy, and are difficult to carry on and off the marine vehicle. However, since the device 100 is scalable, the weight may be greater or smaller than one pound.

The anchoring stake 102 has unique structural configurations that enhance the holding capacity while embedded into the sand or uncompacted soil 308. In this manner, dislodgement of the anchoring stake 102 from the sand or uncompacted soil 308 from the weight and motion of the marine vehicle, or the waves of the body of water, is mostly prevented.

One exemplary anchoring stake 102, shown in FIG. 2, comprises a hollow aluminum tube that is cut along an angle from about the middle section hollow tube 113 to the distal end 20. This unique angled cut, effectively increases the surface area, which provides more resistance against the sand or uncompacted soil 308, i.e., sand/soil, into which the anchoring stake 102 is embedded, without having to increase the overall size of the anchoring stake 102.

Those skilled in the art will recognize that the deeper the anchoring stake 102 penetrates the sand or uncompacted soil 308, the greater the holding capacity thereof. Conversely, increasing the height of the anchoring stake 102 above the surface of the sand or uncompacted soil 308 decreases the holding capacity. Thus, the device 100 includes a step plate 112 that joins with the proximal terminus 150 of the hollow tube 113 of the anchoring stake 102, at an acute angle. The step plate 112 enables at least a portion of the length of the stake to be forcibly introduced into the sand or uncompacted soil 308. In operation, the user simply orients the distal end 20 of the anchoring stake 102 towards the sand or uncompacted soil 308, and steps onto the step plate 112 to press the anchoring stake 102 into the sand or uncompacted soil 308 to a desired depth. This can be performed underwater, so the use of the legs to press down on the anchoring stake 102 is useful.

In some embodiments, the step plate 112 is defined by a generally flat, oval-shape. The step plate 112 comprising a free end 116*a* and an opposing tether end 116*b*. The tether end 116*b* forms a tether attachment eye 118 to which a tether 302, cable, moor line, or other flexible attachment means fastens thereto (See FIG. 5). The tether end 116*b* orients towards the marine vehicle 304, such that the tether attachment eye 118 faces the general direction of the marine vehicle 304. However, it is significant to note, that waves and general buoyancy laws may cause the marine vehicle 304 to float around the circumference of the step plate 112, including opposite the tether attachment eye 118.

Further, the step plate 112 comprises a top face 202 that orients away from the sand or uncompacted soil 308, and an opposing bottom face 114 that orients towards the sand or uncompacted soil 308 while attached to the proximal terminus 150 of the anchoring stake 102. In some embodiments, the bottom face 114 is disposed to join with the proximal terminus 150 of the anchoring stake 102 at an acute angle. In one non-limiting embodiment, the step plate 112 is welded to the terminus of the proximal terminus 150 for the anchoring stake 102. However, in other embodiments, different fastening mechanisms, such as bolts, screws, magnets, clamps, and adhesives may also be used to fasten the step plate 112 to the anchoring stake 102.

As discussed above, the anchoring stake 102 is attached to the proximal terminus 150 in an acute angle relative to a vertical axis 300. The angle can be from 1 to 50 degrees but preferably 15 degrees in an approximate orientation away from a tether line attached to the boat or marine vehicle. This unique sloped disposition is illustrated in FIG. 3. This sloped disposition of the anchoring stake 102, sloping back and away from the marine vehicle serves to increase the required vector force necessary to dislodge the anchoring stake 102 from the sand or uncompacted soil 308.

In some embodiments, the device 100 may also include multiple wings 120*a*, 120*b* that project from the sidewall 104 of the anchoring stake 102. In one non-limiting embodiment, the wings 120*a*, 120*b* project from anchoring stake 102 (See FIG. 6). The wings 120*a*, 120*b* project in opposing directions to create an equilibrium effect inside the sand or uncompacted soil 308. In one possible embodiment, the wings 120*a*, 120*b* have a gradually sloping angle that facilitates insertion of the anchoring stake 102 into the sand or uncompacted soil 308.

Figure 7:
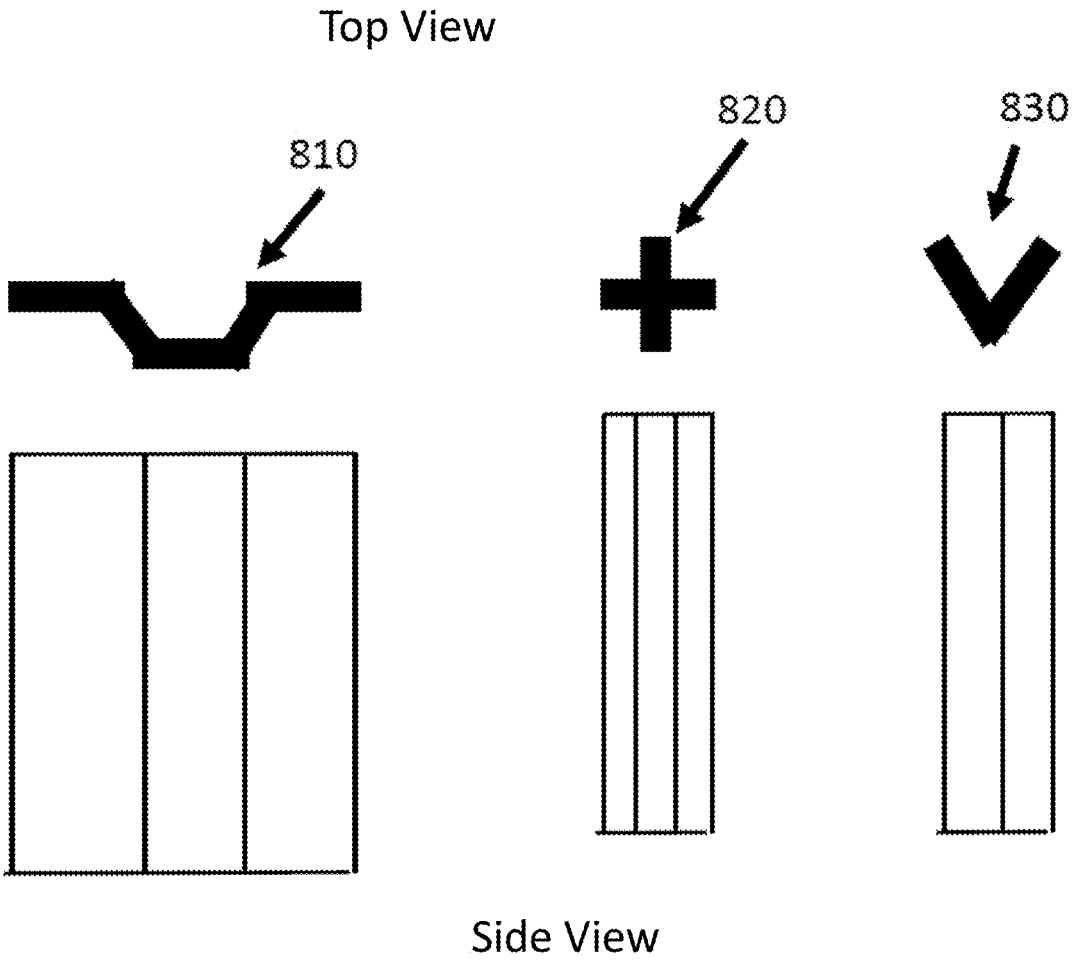
FIG. 7 illustrates various cross sectional embodiments of the anchoring stakes.

As shown in FIG. 7 the anchoring stake 102 can take alternative shapes which provide a wide profile to the sand or uncompacted soil 308 as shown in modified vee profile 810, cruciform 820 and vee shape 830. The shape 810 provides a wide profile for reacting with the sand or uncompacted soil 308 with respect to either wide surface whereas cruciform 820 provides a similar cross section in all primary directions 0 degrees, 90 degrees, 180 degrees and 270 degrees. and vee shape 830 is limited to the inner face where the vee forms a modified cup. Preferably, the anchoring stake 810, 820 and 830 proximal end 10 cross section, adjacent to the step plate 112 is greater than the anchoring stake cross section of distal end 20 of the anchoring stake 810, 820 and 830. This creates a tapering effect.

Figure 8:
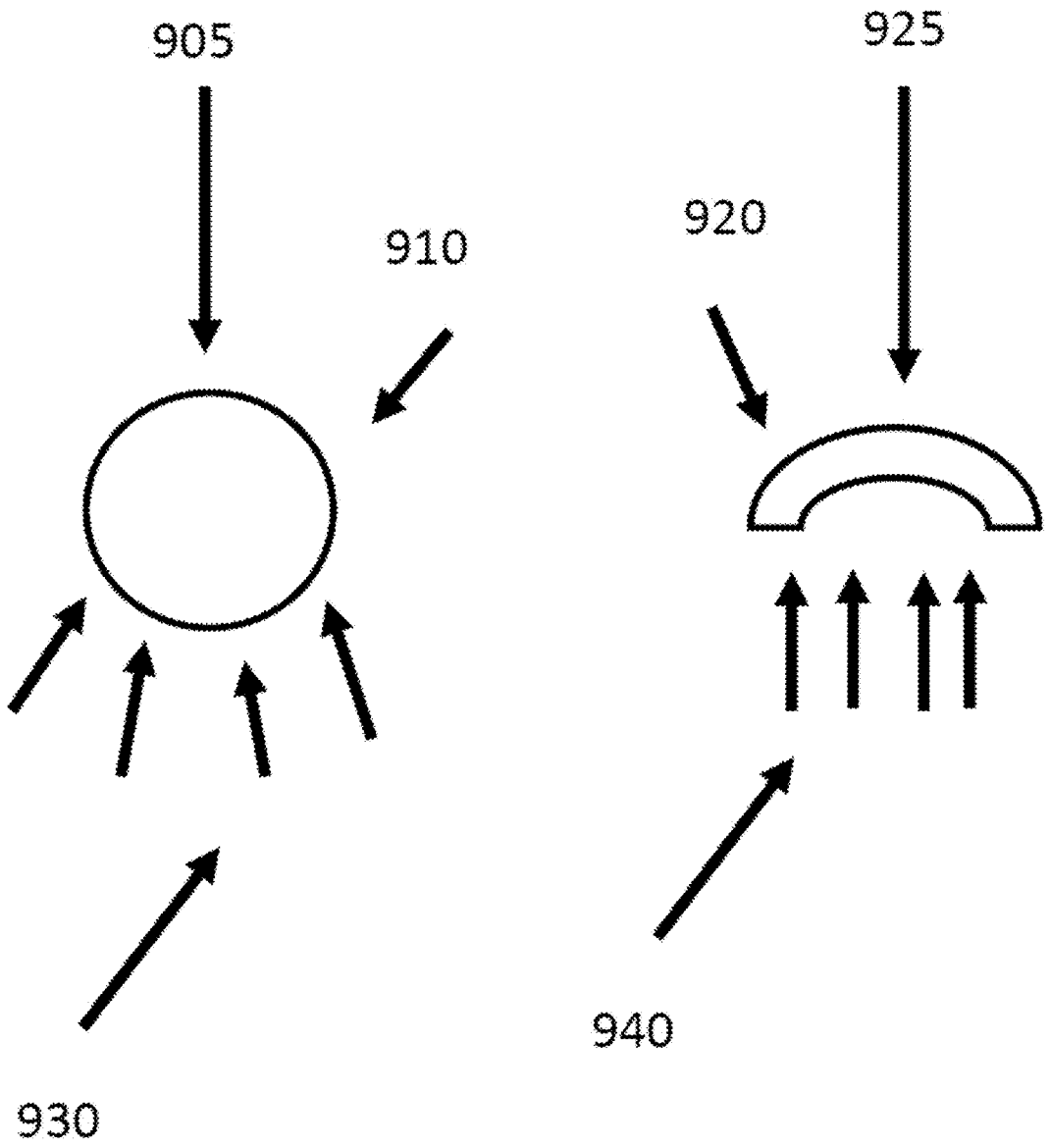
FIG. 8 illustrates a simple force diagram of the distal terminus when in use viewed from a top view perspective.

As shown in FIG. 8 the reason for the cup shape is evident. Round stake 910 when reacted against the sand or uncompacted soil 308 produce resulting force vectors 930 that are tangential to the radius of the stake when resisting force 905. When the cupped shaped 920 is used, the reaction against the sand or uncompacted soil 308 results in force vectors 940 which are parallel to the force 925 and the sand or uncompacted soil 308 provides a greater resistive force than the round stake 910.

Figure 9:
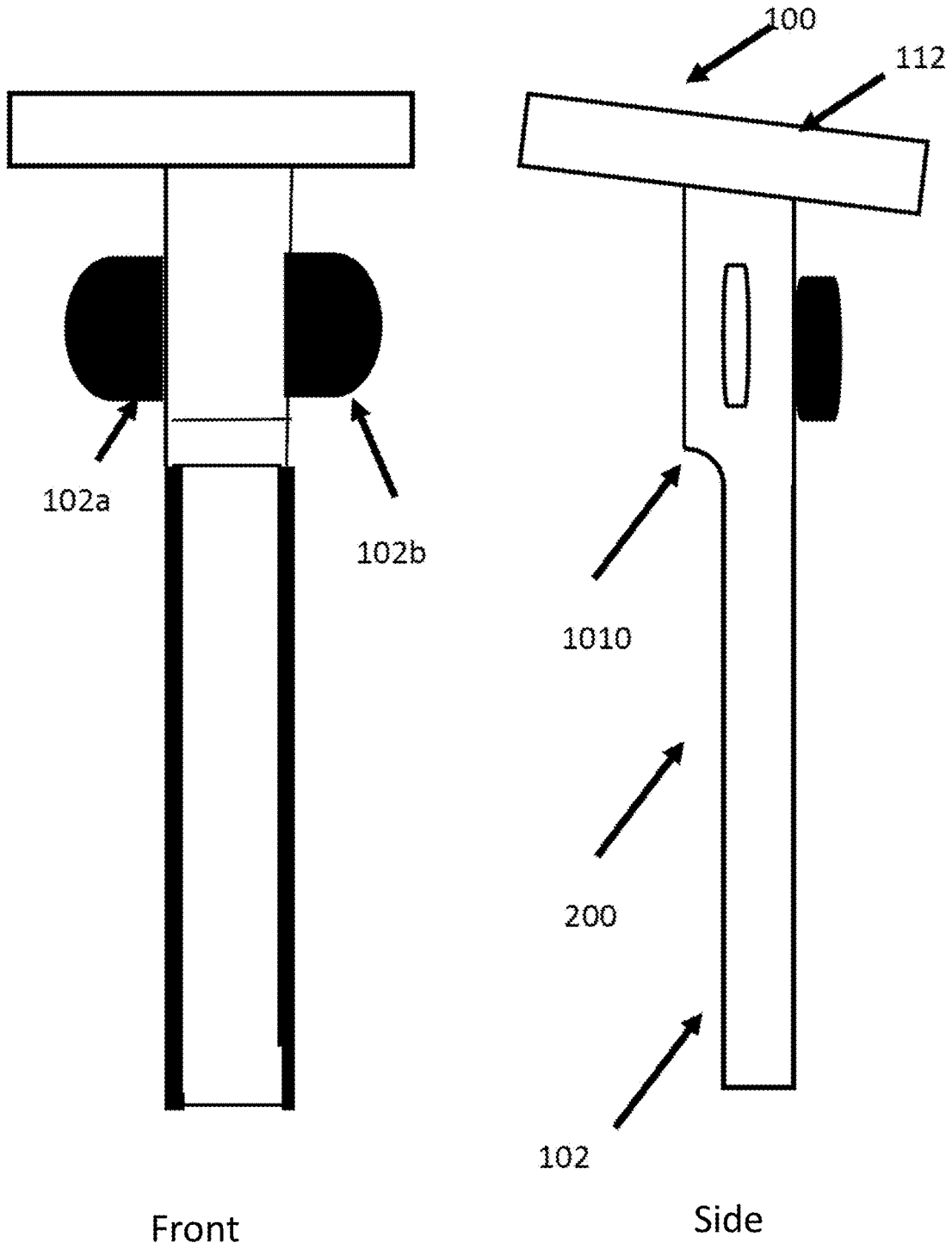
FIG. 9 shows an alternative design where the cavity 200 is formed by cutting the stake longitudinally in half and forming a radius proximal to the wings 102*a* and 102*b*.

As shown in FIG. 9, an alternative design for device 100 having a step plate 112 and anchoring stake 102 is formed from a pipe or tube which forms the cavity 200. Cavity 200 being formed by cutting the stake 102 longitudinally in half and forming a radius 1010 proximal to the wings 102*a* and 102*b*. In this design the wings 102*a* and 102*b* are formed from a single plate welded to anchoring stake 102 and the outlet opening 108 is located 180 degrees from the location of outlet opening 108 shown in FIG. 1.

Figure 10:
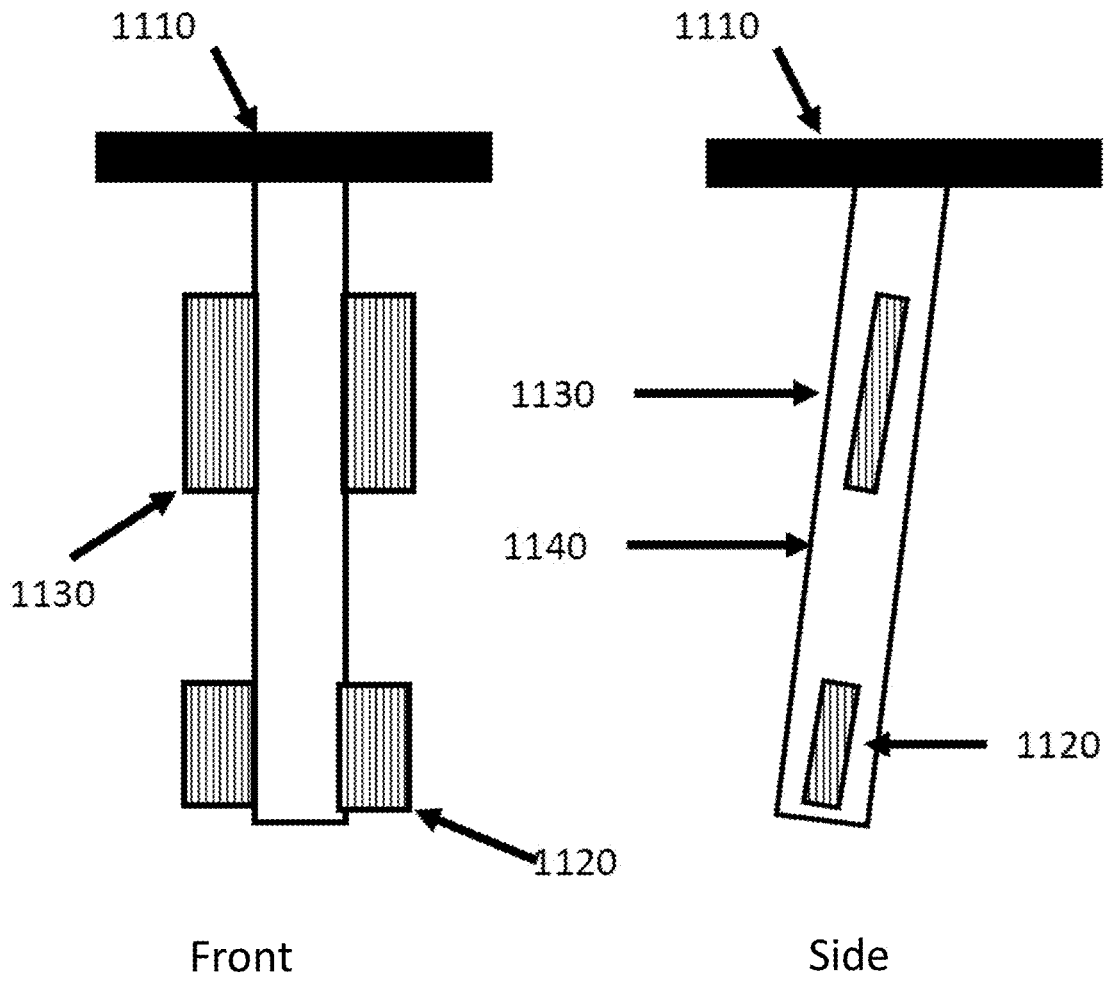
FIG. 10 shows an alternate design with two sets of right and left plates.

As shown in FIG. 10, an alternate design where anchoring stake 1140 has two sets of right and left plates, upper plates 1130 and lower plates 1120.

Figure 11:
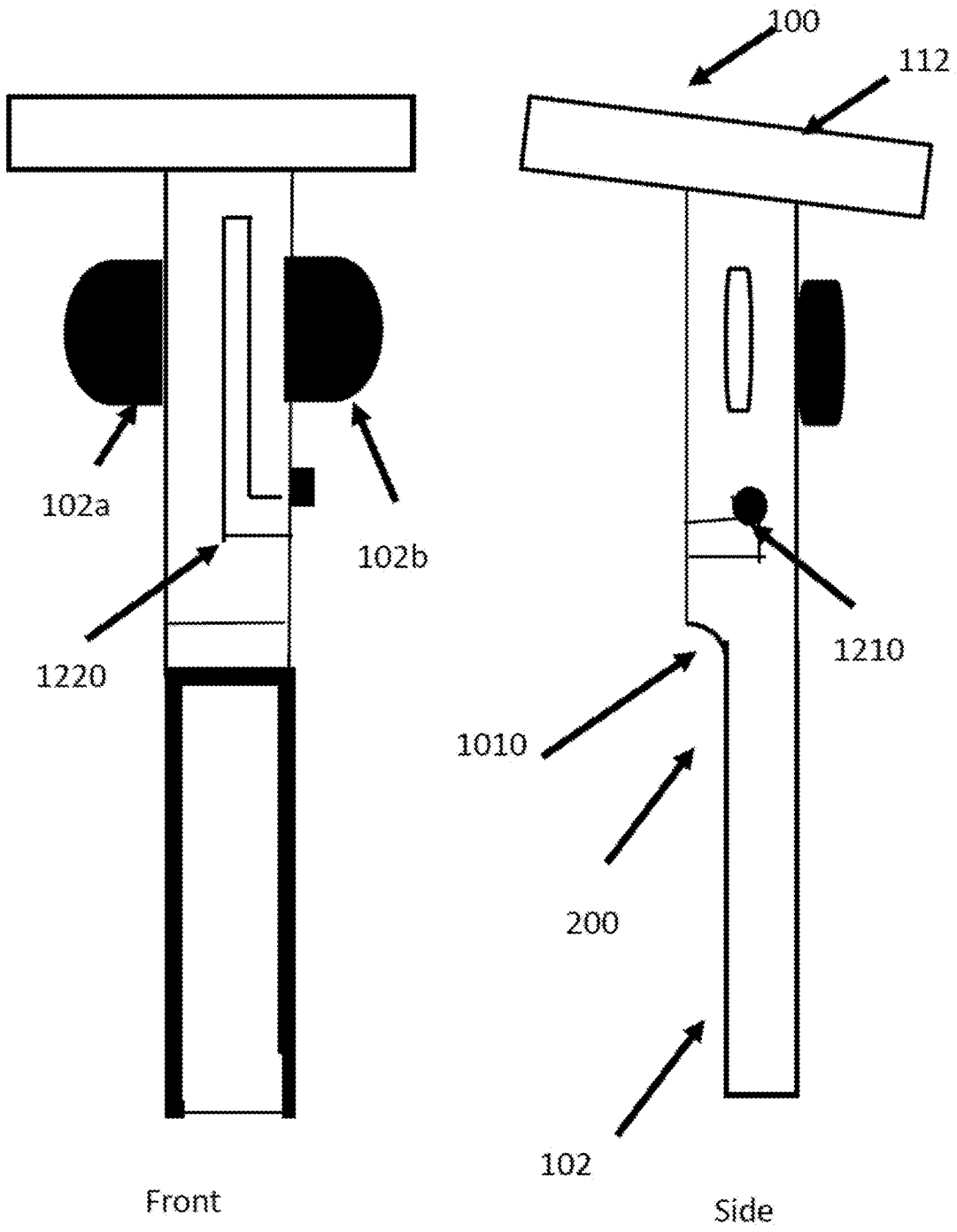
FIG. 11 shows an alternate design with a bayonet assembly. The pin connection shown forms a bayonet connection connecting the step plate section to the anchoring stake.

FIG. 11 shows an alternate design with a bayonet assembly where the anchoring stake 102 is formed from two pieces and bayoneted together when assembled using pin 1210 and bayonet connector 1220.

The projection of the wings 120*a*, 120*b* serves to generate frictional forces against the sand or uncompacted soil 308, as the vector forces attempt to dislodge the anchoring stake 102 from the sand or uncompacted soil 308. However, in other embodiments, the wings 120*a*, 120*b* may project from any point along the length of the sidewalls 104. Further, the wings 120*a*, 120*b* may have various shapes, including a rectangular shape, a triangular shape, a circular shape, a parabolic shape, and an irregular shape. Ribs, or other texture may form on the surface of the wings 120*a*, 120*b* to further increase resistive forces against the sand or uncompacted soil 308.

In another embodiment, the device 100 utilizes two anchor mounts that serve to detachably mount the device 100 in a storage compartment of the marine vehicle. The anchor mounts are configured to hold the device 100 securely and rattle free when not in use. In one embodiment, the anchor mounts detachably couple to the wings 120*a*, 120*b* from a first end, and couple to the storage compartment from a second end.

In operation, the device 100 mounts in a stowage compartment in the marine vehicle. The user easily detaches the device 100 for anchoring operations. The user may then walk, swim, or float to a desired anchor point for embedding the device 100 into the sand or uncompacted soil 308. The lightweight configuration of the device 100 allows the user to carry the device 100 through water while swimming, for example. The distal end 20 of the device 100 of the anchoring stake 102 is oriented towards the sand or uncompacted soil 308 surface. As shown in FIG. 4, the user steps on the step plate 112 to force the anchoring stake 102 into the sand or uncompacted soil 308. As the anchoring stake 102 penetrates the sand or uncompacted soil 308, sand or loose uncompacted soil enters the inlet opening 200 to fill the cavity 106 inside the anchoring stake 102. The tether is then tied to the tether attachment eye 118 in the step plate 112.

The device 100 is inserted into sand or uncompacted soil 308 such that anchoring stake 102 is inserted in sand or uncompacted soil 308 and step plate 112 is above the sand or uncompacted soil 308. When a force 306 is applied to attachment eye 118 the device 100 and anchoring stake 102 being at an acute angle relative to the vertical axis 300 (See FIG. 3) which enhances the holding capacity of the device 100 in the sand or uncompacted soil 308. Also, the resistive forces generated by the wings 120*a*, 120*b*, and the sand or loose uncompacted soil 308 acting against the cupped feature 201 resist dislodgement of the anchoring stake 102 from the sand or uncompacted soil 308 by force 306. The resistive forces generated by the wings 120*a*, 120*b* also provide a counteracting force to resist any rotational movement about the anchoring stake 102 thereby preventing the device 100 from being twisted in the sand or uncompacted soil 308 which would result in loss of holding force of the device 100. After anchoring operations are no longer required, the user can simply stand directly above the anchoring stake 102 and pull upwardly on the step plate 112 of the device 100 attached to anchoring stake 102 to remove the device 100 anchoring stake 102 from the sand or uncompacted soil 308.

It is significant to note that during removal from the sand or uncompacted soil 308 the user may have to move the device 100 such that the anchoring stake 102 motion is in a lateral or in a circular motion to overcome the frictional forces holding the anchoring stake 102 in the sand or uncompacted soil 308. Once the anchoring stake 102 is dislodged, the user can remove the device 100 from the sand or uncompacted soil 308 and wash any remaining sand or uncompacted soil 308 by passing the anchoring stake 102 through water to enable excess sand or loose uncompacted soil 308 to wash out through the at least one outlet opening 108 formed in the sidewalls 104 of the anchoring stake 102.

In yet another embodiment, a mount allows the device 100 to be remounted into the stowage compartment of the marine vehicle when not in use.

In conclusion, a portable marine anchoring device 100 maximizes holding capacity while anchored into the sand or uncompacted soil 308. The device 100 is fabricated from lightweight materials that facilitates carrying and swimming with the device 100.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

The present invention has been described with reference to embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of manufacture, shape, size, or materials which are not specified within the detailed written description or illustrations contained herein are considered within the scope of the present invention.

Insofar as the description above and the accompanying drawings disclose any additional subject matter that is not within the scope of the claims below, the inventions are not dedicated to the public and the right to file one or more applications to claim such additional inventions is reserved.

Although very narrow claims are presented herein, it should be recognized the scope of this invention is much broader than presented by the claim. It is intended that broader claims will be submitted in an application that claims the benefit of priority from this application.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What we claim is:

1. A portable marine anchoring device for use in sand and said sand having a top surface, the portable marine anchoring device comprising:

an anchoring stake and a step plate and said anchoring stake having at least one wing projecting from said anchoring stake and said anchoring stake and said step plate made from a material selected from the group consisting of aluminum, aluminum alloys, titanium, stainless steel, iron, beryllium, magnesium alloys, metal alloys, polymers, wood, and carbon reinforced plastics;

said anchoring stake further comprising a proximal end and a distal end;

said anchoring stake being a foldable anchoring stake and said foldable anchoring stake being connected with a pin;

said anchoring stake having an anchoring stake cross section and said anchoring stake cross section comprising an elongated cavity;

said step plate consisting of a generally flat plate;

said step plate comprising a top face and an opposing bottom face;

said step plate further comprising a free end and a tether end and said tether end having a tether attachment eye;

said opposing bottom face of the step plate having a joint joining said bottom face of the step plate with the proximal end of the anchoring stake, such that the anchoring stake slopes upward in an acute angle relative to a vertical axis towards said free end of the step plate and away from the tether attachment eye;

said portable marine anchoring device inserted into said sand such that said anchoring stake distal end enters said sand first until said bottom face of the step plate is parallel to said sand top surface and said sand is contained within said anchoring stake having the elongated cavity; and a tether connecting said tether attachment eye to a marine vehicle floating on a body of water.

2. The portable marine anchoring device of claim 1 wherein said anchoring stake comprises a sidewall, the sidewall defining the elongated cavity, the sidewall forming at least one outlet opening in fluid communication with the elongated cavity.

3. The portable marine anchoring device of claim 1 wherein said anchoring stake further-comprises said top surface and said opposing bottom surface, and said opposing bottom surface forming an inlet opening in fluid communication with the elongated cavity.

4. The portable marine anchoring device of claim 1 wherein said anchoring stake cross section comprises of circular shape, oval shape, rectangular shape, triangular shape, cruciform shape, vee shape and modified vee shape.

* * * * *